US009463342B2

(12) United States Patent
Ivy

(10) Patent No.: US 9,463,342 B2
(45) Date of Patent: Oct. 11, 2016

(54) FOG-CLOUD GENERATED NOZZLE

(71) Applicant: International Fog, Inc., Vancouver, WA (US)

(72) Inventor: Eugene W. Ivy, Portland, OR (US)

(73) Assignee: International Fog, Inc., Vancouver, WA (US)

( * ) Notice: Subject to any disclaimer, the term of this patent is extended or adjusted under 35 U.S.C. 154(b) by 0 days.

(21) Appl. No.: 14/660,633

(22) Filed: Mar. 17, 2015

(65) Prior Publication Data

US 2015/0258357 A1 Sep. 17, 2015

Related U.S. Application Data

(60) Provisional application No. 61/954,428, filed on Mar. 17, 2014.

(51) Int. Cl.
*A62C 31/02* (2006.01)
*B05B 1/08* (2006.01)

(52) U.S. Cl.
CPC ..... *A62C 31/02* (2013.01); *B05B 1/083* (2013.01)

(58) Field of Classification Search
CPC ..... B05B 1/083; B05B 1/341; B05B 1/3405; A62C 31/02
USPC ..... 239/222, 461, 463, 553, 556, 558, 561, 239/589, 590
See application file for complete search history.

(56) References Cited

U.S. PATENT DOCUMENTS 354,204 A 12/1886 McLaughlin
409,796 A 8/1889 Magaldi
540,218 A 5/1895 Stanton et al.
674,343 A 5/1901 Oakes
843,585 A 2/1907 Cole
1,761,119 A 6/1930 Gouldbourn
1,953,837 A 4/1934 Thorold et al.
1,959,886 A 5/1934 Wadsworth
2,246,797 A 6/1941 Geddes
2,413,083 A 12/1946 Snowden et al.
2,499,092 A 2/1950 Burnam
2,526,265 A 10/1950 Nulph
2,756,829 A 7/1956 Phillips
2,813,753 A 11/1957 Roberts
2,884,075 A 4/1959 Poon
2,896,861 A 7/1959 Hruby
2,979,272 A 4/1961 Thorrez
2,990,885 A 7/1961 Brazier
3,082,960 A 3/1963 Swan
3,116,018 A 12/1963 Kunz
3,125,297 A 3/1964 Copeland et al.
D210,600 S 3/1968 Werner
D212,612 S 11/1968 Campbell
3,424,250 A 1/1969 Thomae (Continued)

*Primary Examiner* — Jason Boeckmann

(74) *Attorney, Agent, or Firm* — Chernoff Vilhauer McClung & Stenzel, LLP

(57) ABSTRACT

A fog-cloud generating nozzle is disclosed. In one embodiment, a nozzle head having a fluid passageway is threadable coupled to a nozzle base. The nozzle base, which provides a threadable coupling to a water source, is disposed in fluid communication with the fluid passageway. An inner sleeve is rotationally disposed within the fluid passageway with bearing surfaces against the nozzle head and the nozzle base. Multiple discharge ports of the nozzle head and multiple discharge orifices of the inner sleeve cooperate to generate a fog-cloud having a magnified forward thrust component and enabled directional control.

20 Claims, 4 Drawing Sheets

(56) References Cited

U.S. PATENT DOCUMENTS

| | | | | |
|---|---|---|---|---|
| D215,844 | S | 11/1969 | Campbell | |
| 3,661,211 | A | 5/1972 | Powers | |
| 3,713,587 | A | 1/1973 | Carson | |
| 3,713,589 | A | 1/1973 | McNair et al. | |
| 3,731,878 | A | 5/1973 | Lubetzky et al. | |
| 3,913,845 | A * | 10/1975 | Tsuji | F02M 61/182 239/432 |
| 4,291,835 | A | 9/1981 | Kaufman | |
| 4,582,255 | A | 4/1986 | Won | |
| 4,674,686 | A | 6/1987 | Trapp | |
| 4,697,740 | A | 10/1987 | Ivy | |
| 4,700,894 | A * | 10/1987 | Grzych | A62C 31/02 169/70 |
| 4,789,099 | A | 12/1988 | Hager | |
| 4,802,535 | A | 2/1989 | Bakke | |
| D307,649 | S | 5/1990 | Henry | |
| 5,104,044 | A | 4/1992 | Ratell, Jr | |
| 5,211,337 | A | 5/1993 | Lukez | |
| D339,846 | S | 9/1993 | Magee | |
| 5,253,716 | A | 10/1993 | Mitchell | |
| 5,316,218 | A | 5/1994 | Bowen | |
| D351,642 | S | 10/1994 | Mitchell | |
| 5,351,891 | A | 10/1994 | Hansen et al. | |
| 5,409,067 | A | 4/1995 | Esposito et al. | |
| 5,540,284 | A | 7/1996 | Esposito et al. | |
| 5,655,608 | A | 8/1997 | Sundholm | |
| 5,699,862 | A | 12/1997 | Rey | |
| 5,833,005 | A | 11/1998 | Woolcock | |
| 5,918,813 | A | 7/1999 | Rucker | |
| 6,098,642 | A | 8/2000 | Crane | |
| 6,158,521 | A | 12/2000 | Klump | |
| 6,322,027 | B1 | 11/2001 | Hsu | |
| 6,398,136 | B1 | 6/2002 | Smith | |
| D462,109 | S | 8/2002 | Adams | |
| 6,488,098 | B1 | 12/2002 | Davis et al. | |
| 6,578,796 | B2 | 6/2003 | Maeda | |
| 6,971,451 | B2 | 12/2005 | Schmieg | |
| 7,090,153 | B2 | 8/2006 | King et al. | |
| 8,308,082 | B2 | 11/2012 | Ivy | |
| 8,807,233 | B2 * | 8/2014 | Peltola | A62C 31/22 169/45 |
| 2002/0139543 | A1 | 10/2002 | Baughman | |
| 2003/0089507 | A1 | 5/2003 | Carrier et al. | |

* cited by examiner

FOG-CLOUD GENERATED NOZZLE

PRIORITY STATEMENT

This application claims priority from U.S. Patent Application Ser. No. 61/954,428 entitled "Fog-Cloud Generating Nozzle" and filed on Mar. 17, 2014 in the name of Eugene W. Ivy; which is hereby incorporated by reference for all purposes.

TECHNICAL FIELD OF THE INVENTION

This invention relates, in general, to the field of fluid discharge and spray generating nozzles, and in particular, to a fog-cloud generating nozzle that produces a large volume of fog or mist for an application such as fire fighting or humidification, for example.

BACKGROUND OF THE INVENTION

Without limiting the scope of the present disclosure, its background will be described with reference to fire fighting, as an example. It is well known that water absorbs not only heat but also many of the toxic gases of a fire and tends to clear away the smoke and does so most effectively when broken up into a fine spray. Spray generating nozzles distribute the water discharge over a larger volume than do conventional fluid discharge nozzles wherein water is discharged in a converging pattern of diffused solid streams. Spray generating nozzles are particularly useful in combating interior fires and are often used to provide protection for firefighting personnel by creating a water spray shield around the firefighters. For these reasons, a continuing interest and need exist in improving fire fighting equipment generally and water spray projection equipment in particular, especially with respect to efficacy and water consumption.

SUMMARY OF THE INVENTION

It would be advantageous to achieve advances in fluid discharge and spray generating nozzles to improve the efficacy of fire fighting equipment. It would also be desirable to enable a mechanical solution that would be efficiently fight fires with reduced water consumption. To better address one or more of these concerns, a fog-cloud generating nozzle is disclosed. In one embodiment, a nozzle head having a fluid passageway is threadable coupled to a nozzle base. The nozzle base, which provides a threadable coupling to a water source, is disposed in fluid communication with the fluid passageway. An inner sleeve is rotationally disposed within the fluid passageway with bearing surfaces against the nozzle head and the nozzle base. Multiple discharge ports of the nozzle head and multiple discharge orifices of the inner sleeve cooperate to generate a fog-cloud having a magnified forward thrust component and enabled directional control. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
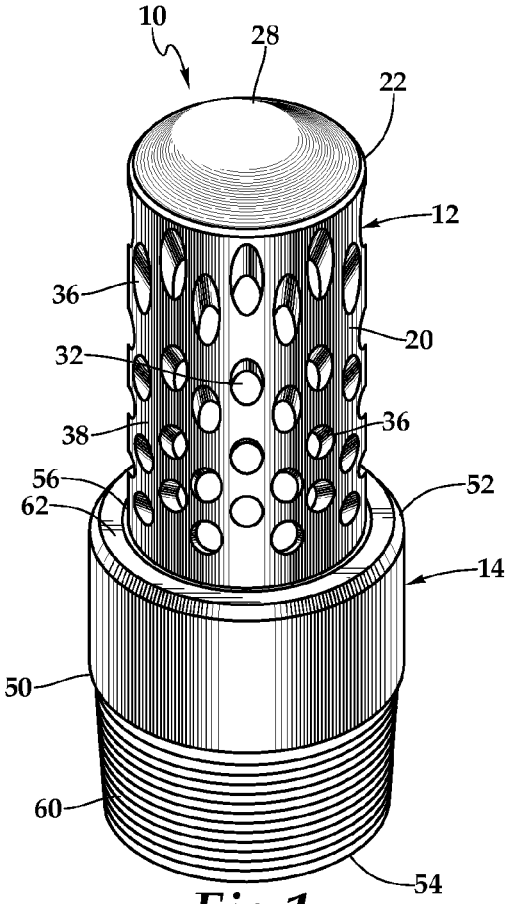
FIG. 1 is a top perspective view of one embodiment of a fog-cloud generating nozzle according to the teachings presented herein.
Figure 2:
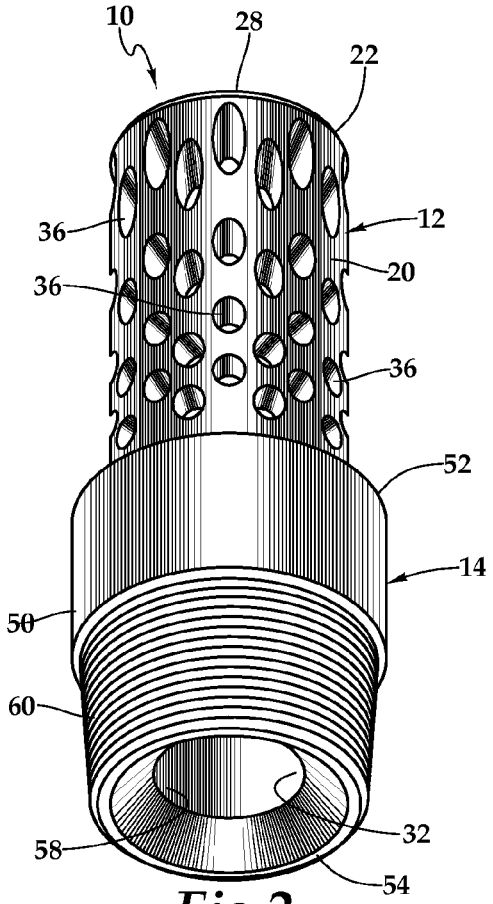
FIG. 2 is a bottom perspective view of the fog-cloud generating nozzle presented in FIG. 1.
Figure 3:
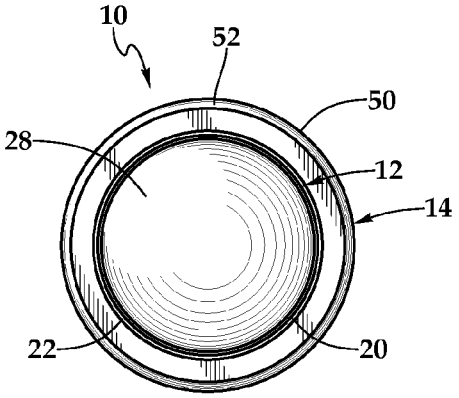
FIG. 3 is a top plan view of the fog-cloud generating nozzle presented in FIG. 1.
Figure 4:
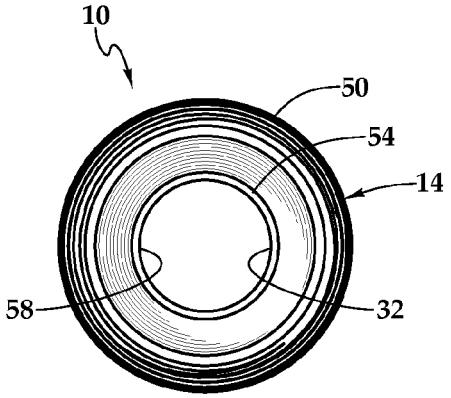
FIG. 4 is a bottom plan view of the fog-cloud generating nozzle presented in FIG. 1.
Figure 5:
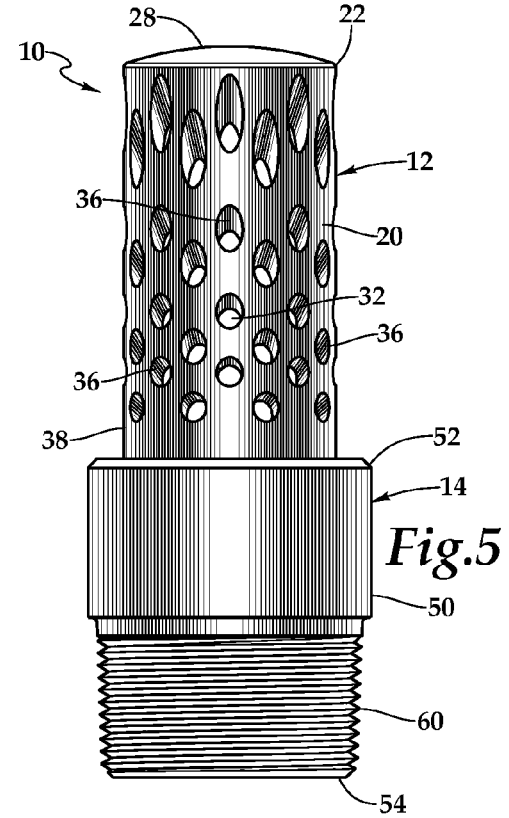
FIG. 5 is a front elevation view of the fog-cloud generating nozzle presented in FIG. 1.
Figure 6:
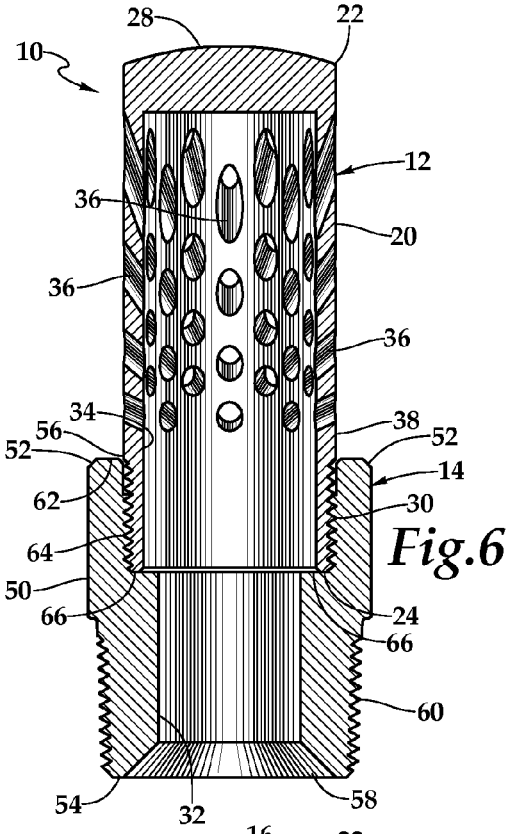
FIG. 6 is a cross-section view of the fog-cloud generating nozzle presented in FIG. 1, wherein two components, one embodiment of a nozzle head, and one embodiment of a nozzle base, are presented in additional detail.
Figure 7:
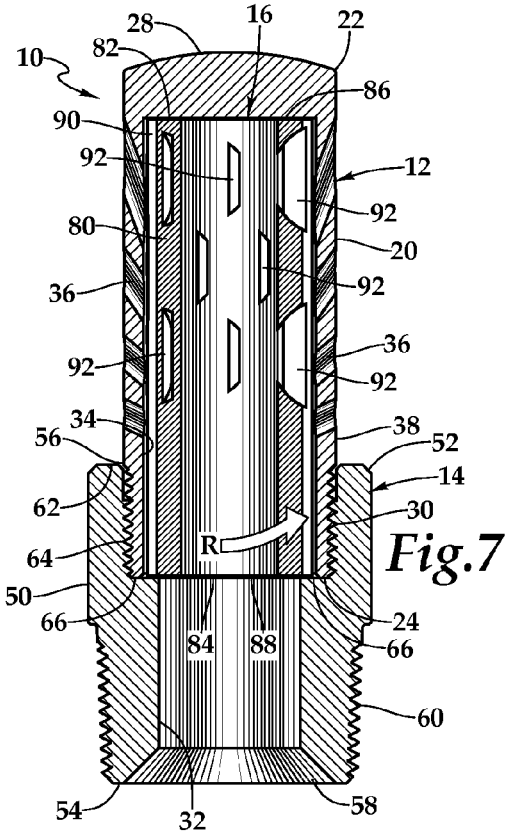
FIG. 7 is a cross-section view of the fog-cloud generating nozzle presented in FIG. 1, wherein three components, the nozzle head, the nozzle base, and one embodiment of an inner sleeve are presented in additional detail.
Figure 8:
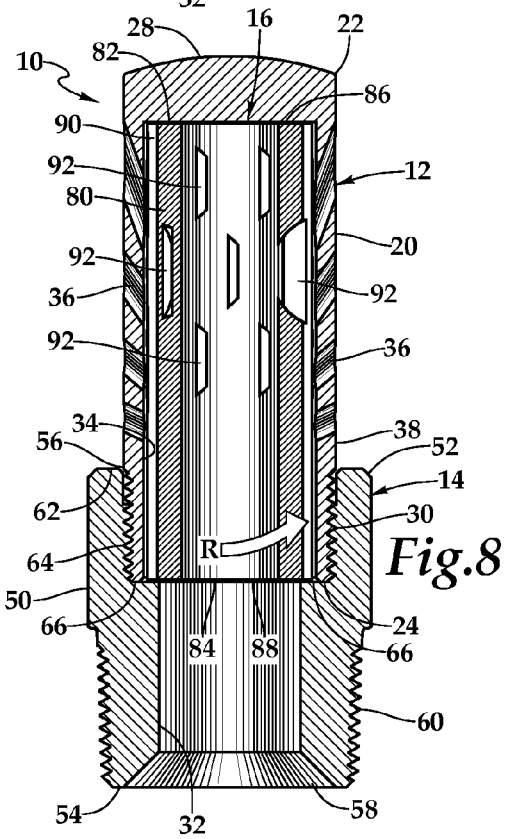
FIG. 8 is a cross-section view of the fog-cloud generating nozzle presented in FIG. 7, wherein during operation, the inner sleeve has rotated.
Figure 9:
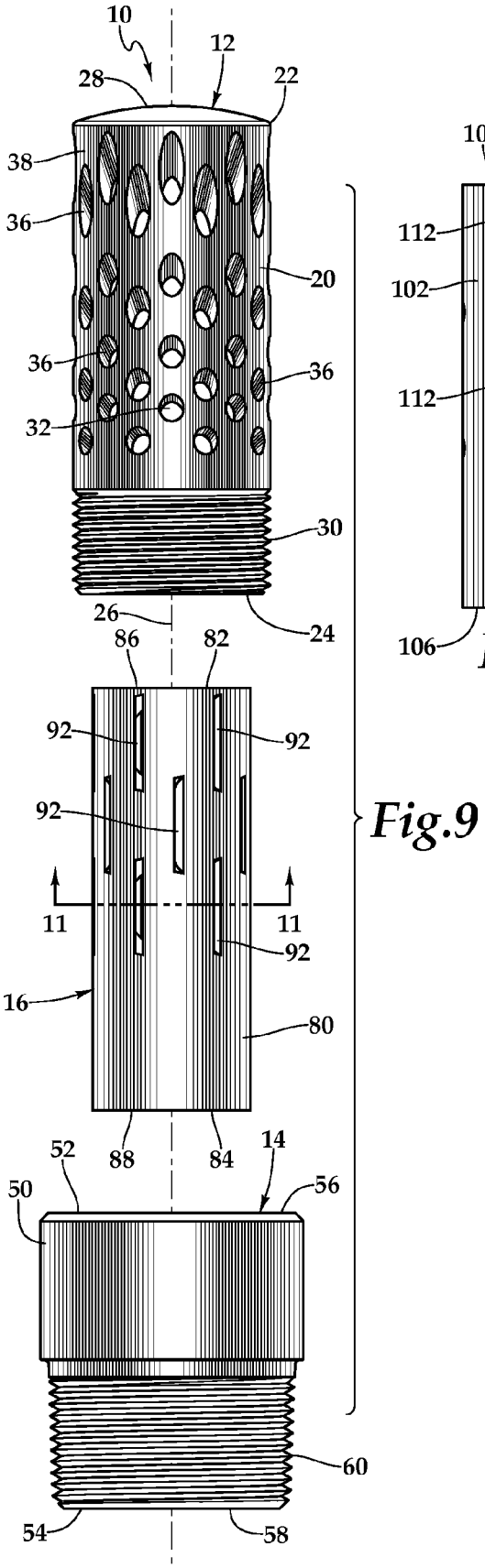
FIG. 9 is front elevation exploded view of the fog-cloud generating nozzle presented in FIG. 1, wherein the three components, the nozzle head, the nozzle base, and the sleeve are presented in additional detail.

Referring initially to FIG. 1, therein is depicted a fog-cloud generating nozzle that is schematically illustrated and generally designated 10. As depicted, the fog-cloud generating nozzle 10 is threadably coupled to a coupling member (not shown), which in turn may be threadably connected to a water conduit (not shown), such as a water pipe or hose. The water conduit may be adapted for connection to a supply main (not shown) for pressurizing the fog-cloud generating nozzle 10. It should be appreciated that the fog-cloud generating nozzle 10 may be employed in a variety of solutions deployed for residential and industrial firefighting applications. In particular, with respect to industrial firefighting applications, the fog-cloud generating nozzle form a portion of an installation, such as retrofitting a sprinkler system or a pump containment system, around a critical system, such as a transformer, or other industrial installation, for example. In such applications, the use of multiple fog-generating nozzles creates an envelope around the protected area that may contain all of the heat and flames created when a fire occurs.

Referring now to FIG. 1 through FIG. 12, more particularly, in one embodiment, the fog-cloud generating nozzle 10 includes a nozzle head 12, a nozzle base 14, and an inner sleeve 16. The nozzle head 12 couples to the nozzle base 14 with the inner sleeve 16 being rotationally disposed concentrically therein with bearing surfaces against the nozzle head 12 and the nozzle base 14. In one implementation, the nozzle head 12 includes a central body portion 20 having a distal end 22 and a proximal end 24. The nozzle head 12 extends along a longitudinal axis 26 and is generally cylindrical shaped. A closed top member 28 is located at the distal end 22 and a threaded coupling member 30 is located at the proximal end 24 with a fluid passageway 32 therein extending from the threaded coupling member 30 to the closed top member 28. As shown, the fluid passageway 32 has a fluid passageway cross-sectional area perpendicular to the longitudinal axis 26.

The nozzle head 12 of the fog-cloud generating nozzle 10 also includes an internal central fluid cavity 34 extending along the longitudinal axis 26 in the central portion thereof. As depicted, multiple elongated ports 36 are distributed axially and circumferentially about the central body portion 20. The elongated ports 36 are configured to provide fluid communication between the internal central fluid cavity and a surface 38 of the nozzle head 12, i.e., the exterior of the fog-cloud generating nozzle 10.

Figure 10A:
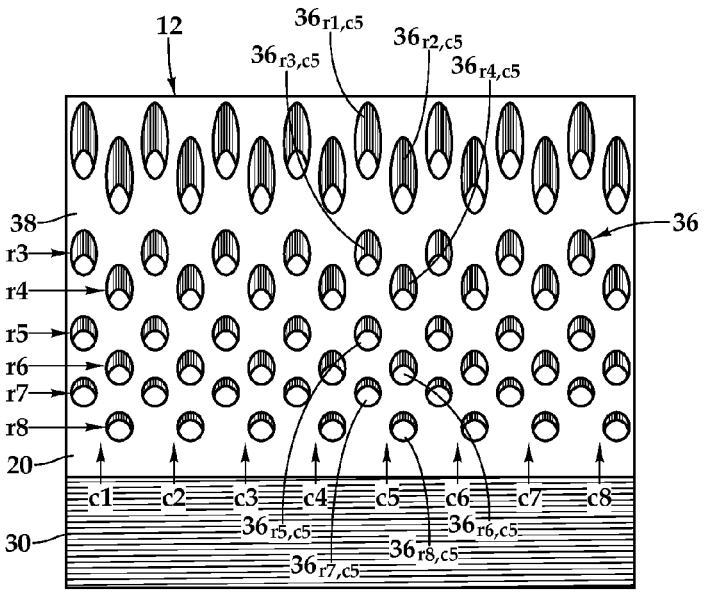
FIG. 10A is a front elevation view of the nozzle head, which forms a portion of the fog-cloud generating nozzle presented in FIG. 1, wherein the nozzle head is unraveled for purposes of explanation.
Figure 10B:
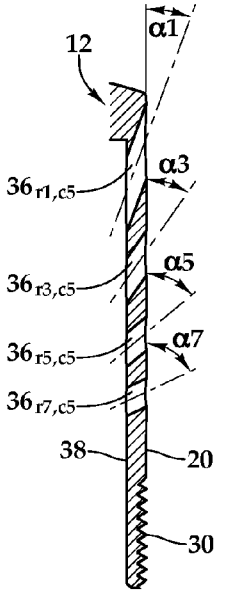
FIG. 10B is a cross-sectional view of the nozzle head in FIG. 10A as taken along line 10B-10B of FIG. 10A.
Figure 10C:
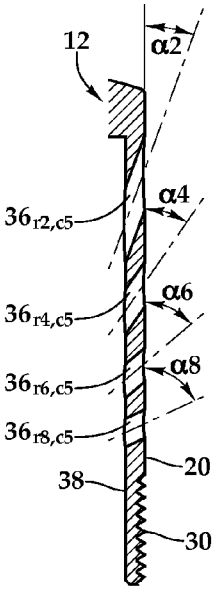
FIG. 10C is a cross-sectional view of the nozzle head in FIG. 10A as taken along line 10C-10C of FIG. 10A.

With particular reference to FIGS. 10A, 10B, and 10C, the elongated ports 36 are disposed in rows and columns; the rows being labeled r1, r2, r3, r4, r5, r6, r7, and r8 and the columns being labeled c1, c2, c3, c4, c5, c6, c7, and c8. In one embodiment, there are approximately eight rows and approximately eight columns, with the rows and columns positioned in a close-fit packing arrangement. By way of illustrative example, particular elongated ports are labeled: elongated ports $\mathbf{36}_{r1,c5}$, $\mathbf{36}_{r2,c5}$, $\mathbf{36}_{r3,c5}$, $\mathbf{36}_{r4,c5}$, $\mathbf{36}_{r5,c5}$, $\mathbf{36}_{r6,c5}$, $\mathbf{36}_{r7,c5}$, and $\mathbf{36}_{r8,c5}$, wherein, for example, $\mathbf{36}_{r1,c5}$ indicates the elongated port 36 on the first row at the fifth column. It should be appreciated, however, that other configurations of elongated ports are within the teachings presented herein and the number and positioning of elongated ports will depend on the application for which the fog-cloud generating nozzle is being employed.

In the illustrated embodiment, each elongated port 36 includes an acute pitch angle, α, relative to the longitudinal axis 26, so that during operation, fluid exists the elongated ports 36 toward the distal end 22. As shown, in one embodiment, the acute pitch of each row r1 through r8 of the elongated ports 36 is greater than the acute pitch of the previous row. The actuate pitch of each row r1 through r7 may progress through acute pitches of approximately 20 degrees, 35 degrees, 50 degrees, 65 degrees, and 80 degrees. The eighth row r8 may also be 80 degrees. With reference to FIGS. 10B and 10C, elongated ports $\mathbf{36}_{r1,c5}$, $\mathbf{36}_{r2,c5}$, $\mathbf{36}_{r3,c5}$, $\mathbf{36}_{r4,c5}$, $\mathbf{36}_{r5,c5}$, $\mathbf{36}_{r6,c5}$, $\mathbf{36}_{r7,c5}$ and $\mathbf{36}_{r8,c5}$ have respective acute pitches of α1 (20 degrees), α2 (20 degrees), α3 (35 degrees), α4 (35 degrees), α5 (50 degrees), α6 (50 degrees), α7 (65 degrees), and α8 (80 degrees).

Referring again to FIGS. 1 through 12, like the nozzle head 12, the nozzle base 14 extends along the longitudinal axis 26 and includes a body member 50 including a distal end 52 and a proximal end 54 wherein an opening 56 is at the distal end 52 and an opening 58 is at the proximal end 54. As shown, the fluid passageway 32 extends therethrough. A threaded coupling 60 is located at a flange 62, which extends from the distal end 52, in order to mate with the threaded coupling 30 of the nozzle head 12. At the other end, threaded coupling member 64 is disposed to mate with an external water source. Further, as shown, the nozzle head 12 may include a shoulder member at a base of the flange 62 to provide a bearing surface for the inner sleeve 16.

Referring now to FIG. 7 through FIG. 9, FIG. 11, and FIG. 14, in one embodiment, the inner sleeve 16 extends along the longitudinal axis 26 and is generally cylindrical shaped. The inner sleeve 16 includes a main body 80 sized for a bearing engagement between the closed top member 28 of the nozzle head 12 and the shoulder 66 of the nozzle base 14. The inner sleeve 16 is positioned with the central fluid cavity 34 of the nozzle head 12. The main body 80 includes a distal end 82, a proximal end 84 with an opening 86 at the distal end 82 and an opening 88 at the proximal end 84. As illustrated, an annular chamber 90 is formed between the inner sleeve 16 and the nozzle head 12, with the fluid passageway extending through the inner sleeve 16.

Figure 11:
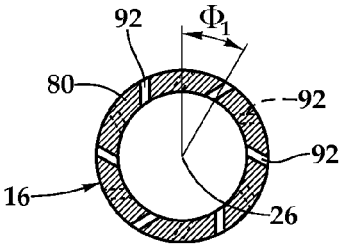
FIG. 11 is a cross-sectional view of the inner sleeve, which forms a portion of the fog-cloud generating nozzle presented in FIG. 1, along line 11-11 of FIG. 9.

Referring particularly to FIG. 11, as shown, the inner sleeve 16 includes multiple orifices 92 distributed axially and circumferentially about the main body 80. Each of the orifices 92 extends along a respective orifice axis, which may be at a positive acute pitch, Φ1, of approximately 30 degrees relative to the longitudinal axis 26 so that during operation fluid exits the orifices 92 from the fluid passageway 32 into the annular chamber 90 toward the distal end 22 of the nozzle head 12. Each orifice axis is at the positive acute radial angle with respect to corresponding radial lines extending in planes perpendicular to the longitudinal axis 26 so that during operation fluid exists the orifices 92 toward a rotational direction, thereby imparting a rotation to the inner sleeve 16. With respect to FIGS. 7 and 8, the rotation R of the inner sleeve 16 is shown.

Figure 13:
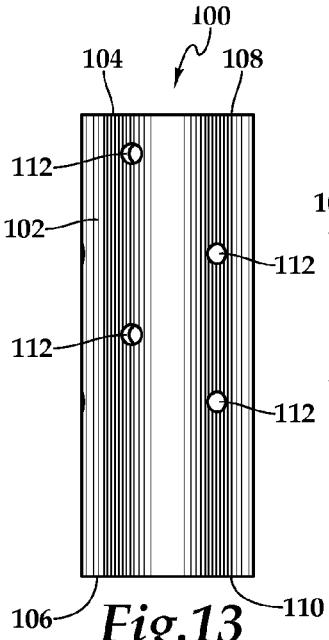
FIG. 13 is a front elevation view of another embodiment of an inner sleeve, which may form a portion of the fog-cloud generating nozzle presented in FIG. 1.
Figure 14:
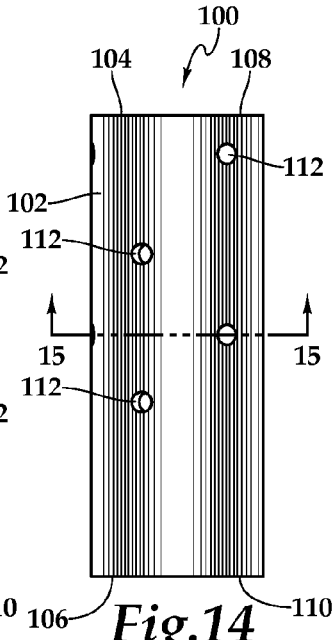
FIG. 14 is a front elevation view of the inner sleeve depicted in FIG. 13, wherein the inner sleeve is rotated 180 degrees.
Figure 15:
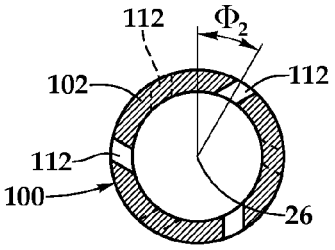
FIG. 15 is a cross-sectional view of the inner sleeve depicted in FIG. 13, taken along line 15-15 of FIG. 14.
Figure 12:
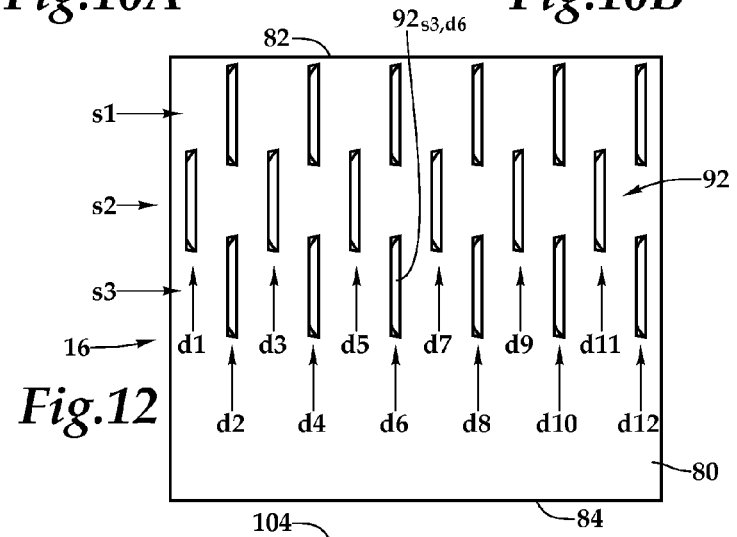
FIG. 12 is a front elevation view of the inner sleeve, which forms a portion of the fog-cloud generating nozzle presented in FIG. 1, wherein the inner sleeve is unraveled for purposes of explanation.
Figure 16:
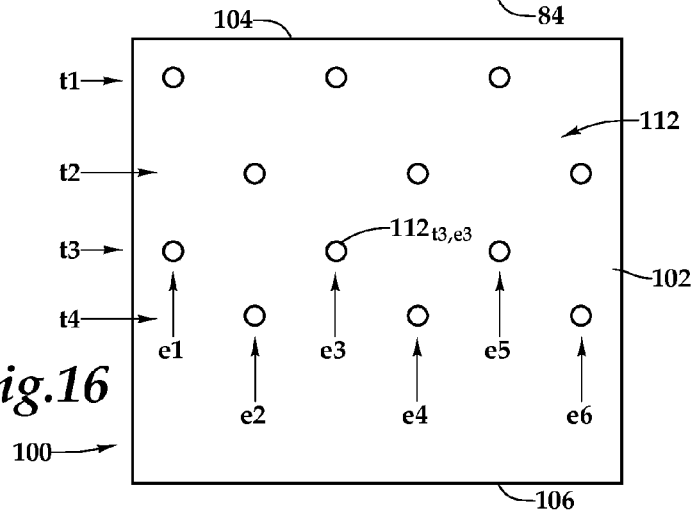
FIG. 16 is a front elevation view of the inner sleeve depicted in FIG. 13, wherein the inner sleeve is unraveled for purposes of explanation.

Referring now to FIG. 12, in one embodiment, the orifices 92 may be slots. As shown, the slots may be in three rows, s1, s2, and s3 with 12 columns, d1, d2, d3, d4, d5, d6, d7, d8, d9, d10, d11, and d12. A particular slot $\mathbf{92}_{s3,d6}$ is the third row and sixth column. As will be appreciated, the number and positioning of the orifices may vary depending on the application and particulars, such as available water supply and pressure. By way of further example, referring now to FIG. 13 through FIG. 15, another embodiment of a sleeve 100 is depicted including a main body 102 having a distal end 104, a proximal end 106 with an opening 108 at the distal end 104 and an opening 100 at the proximal end 106. In this embodiment, the orifices are punches having a positive acute pitch, Φ2, of approximately 30 degrees with a four row, t1, t2, t3, t4 and six column, e1, e2, e3, e4, e5, e6 presentation wherein a particular orifice 112 such as orifice $\mathbf{112}_{t3,e3}$ indicates the orifice on the third row and third column.

In operation, the water supply enters the fluid passageway at the nozzle base 14 and then the central fluid cavity 34, which is within the nozzle head 12 and the inner sleeve 16. The discharge of the water through the orifices 92 creates a reaction force having a component which is tangential to the curved cylindrical surface of the main body 80 of the inner sleeve 16, as well as a component which is normal thereto. The tangential component imparts rotational motion (e.g., rotation R) to the inner sleeve 16 in much the same manner that a jet engine turbine is turned by the reaction force produced by the flow of combustion gases through the engine nozzles. The centrifugal force associated with the rotation of the inner sleeve 16 breaks up the water particles in the water supply into a fine mist or fog. The water particles travel outwardly through the elongated ports 36 of the nozzle head 12, which imparts a spiral pattern with a forward thrust component enabling not only the direction of the generated fog-cloud to be controlled, but sufficient energy to impart a sufficient distance of carry.

Extended coverage may be obtained from available high pressure water supply sources or mains, and because of the substantially reduced back pressure within the design, a large delivery rate is obtained, thus enabling the fog-cloud generating nozzle to extinguish a fire and cool down the source prior to approach by firefighting personnel or, alternatively, containment is also provided to prevent the fire from spreading. Because of the finely particulated nature of the discharged water droplets in the fog-cloud, heat from the fire source causes the water droplets to flash to steam, thereby removing heat from the fire by increasing the temperature of the discharged water droplets to the flash point and by latent heat of vaporization, which causes the water droplets to make the transition to the vapor state.

The order of execution or performance of the methodologies illustrated and described herein is not essential, unless otherwise specified. That is, elements of the methods may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A fog-cloud generating nozzle comprising:

a nozzle head extending along a longitudinal axis and being generally cylindrical shaped, the nozzle head having a central body portion including a proximal end and a distal end;

the nozzle head having a closed top member at the distal end and a threaded coupling member at the proximal end with a fluid passageway therein extending from the threaded coupling member to the closed top member, the fluid passageway having a fluid passageway cross-sectional area perpendicular to the longitudinal axis;

the nozzle head having an internal central fluid cavity extending along the longitudinal axis in the central portion thereof;

the nozzle head having a plurality of elongated ports distributed axially and circumferentially about the central body portion, the plurality of elongated ports configured to provide fluid communication between the internal central fluid cavity and a surface of the nozzle;

the plurality of elongated ports being disposed in rows, each row having an acute pitch angle relative to the longitudinal axis so that during operation fluid exits the plurality of elongated ports toward the distal end;

the acute pitch of each row of the plurality of elongated ports being greater than the acute pitch of the previous row;

a nozzle base extending along the longitudinal axis, the nozzle base having a body member including a distal end and a proximal end, the fluid passageway extending therethrough;

the nozzle base having a flange extending from the distal end, a first threaded coupling member is disposed at the flange and configured to mate with the threaded coupling member of the nozzle base;

the nozzle base including a shoulder member at a base of the flange;

the nozzle head including a second threaded coupling member disposed at the proximal end, the second threaded coupling configured to mate with a water source;

an inner sleeve extending along the longitudinal axis and being generally cylindrical shaped, the inner sleeve having a main body sized for a bearing engagement between the closed top member of the nozzle head and the shoulder of the nozzle base, an annular chamber being formed between the inner sleeve and the nozzle head, the fluid passageway extending therethrough; and the inner sleeve including a plurality of orifices distributed axially and circumferentially about the main body, each of the plurality of orifices extending along a respective orifice axis, each orifice axis being at a positive acute pitch relative to the longitudinal axis so that during operation fluid exits the plurality of orifices from the fluid passageway into the annular chamber toward the distal end of the nozzle head, each orifice axis being at the positive acute radial angle with respect to corresponding radial lines extending in planes perpendicular to the longitudinal axis so that during operation fluid exits the plurality of orifices toward a rotational direction, thereby imparting a rotation to the inner sleeve.

2. The fog-cloud generating nozzle as recited in claim 1, wherein the nozzle head is statically connected to the nozzle base by the threadable connection therebetween.

3. The fog-cloud generating nozzle as recited in claim 1, wherein the plurality of elongated ports further comprise a first row of elongated ports having approximately eight ports.

4. The fog-cloud generating nozzle as recited in claim 3, wherein the each elongated port of the first row of elongated ports further comprises an acute pitch of approximately 20 degrees.

5. The fog-cloud generating nozzle as recited in claim 1, wherein the plurality of elongated ports further comprise a second row of elongated ports having approximately eight ports.

6. The fog-cloud generating nozzle as recited in claim 5, wherein each elongated port of the second row of elongated ports further comprises an acute pitch of approximately 35 degrees.

7. The fog-cloud generating nozzle as recited in claim 1, wherein the plurality of elongated ports further comprise a third row of elongated ports having approximately eight ports.

8. The fog-cloud generating nozzle as recited in claim 7, wherein each elongated port of the third row of elongated ports further comprises an acute pitch of approximately 50 degrees.

9. The fog-cloud generating nozzle as recited in claim 1, wherein the plurality of elongated ports further comprise a fourth row of elongated ports having approximately eight ports.

10. The fog-cloud generating nozzle as recited in claim 9, wherein each elongated port of the fourth row of elongated ports further comprises an acute pitch of approximately 65 degrees.

11. The fog-cloud generating nozzle as recited in claim 1, wherein the plurality of elongated ports further comprise a fifth row of elongated ports having approximately eight ports.

12. The fog-cloud generating nozzle as recited in claim 11, wherein each elongated port of the fifth row of elongated ports further comprises an acute pitch of approximately 80 degrees.

13. The fog-cloud generating nozzle as recited in claim 1, wherein the plurality of elongated ports further comprise a sixth row of elongated ports having approximately eight ports.

14. The fog-cloud generating nozzle as recited in claim 13, wherein each elongated port of the sixth row of elongated ports further comprises an acute pitch of approximately 80 degrees.

15. The fog-cloud generating nozzle as recited in claim 1, wherein the plurality of orifices further comprises an opening selected from the group of slots and punches.

16. The fog-cloud generating nozzle as recited in claim 15, wherein each of the plurality of orifices further comprises an acute pitch of approximately 30 degrees.

17. A fog-cloud generating nozzle comprising:

a nozzle head extending along a longitudinal axis and being generally cylindrical shaped, the nozzle head having a central body portion including a proximal end and a distal end;

the nozzle head having a closed top member at the distal end and a threaded coupling member at the proximal end with a fluid passageway therein extending from the threaded coupling member to the closed top member, the fluid passageway having a fluid passageway cross-sectional area perpendicular to the longitudinal axis;

the nozzle head having an internal central fluid cavity extending along the longitudinal axis in the central portion thereof;

the nozzle head having a plurality of elongated ports distributed axially and circumferentially about the central body portion, the plurality of elongated ports configured to provide fluid communication between the internal central fluid cavity and a surface of the nozzle;

the plurality of elongated ports being disposed in rows, each row having an acute pitch angle relative to the longitudinal axis so that during operation fluid exits the plurality of elongated ports toward the distal end, each row including approximately eight elongated ports, the rows being disposed in a close-packing arrangement;

the acute pitch of each row of the plurality of elongated ports being greater than the acute pitch of the previous row, the acute pitch of each row progressing through acute pitches of approximately 20 degrees, 35 degrees, 50 degrees, 65 degrees, and 80 degrees;

a nozzle base extending along the longitudinal axis, the nozzle base having a body member including a distal end and a proximal end, the fluid passageway extending therethrough;

the nozzle base having a flange extending from the distal end, a first threaded coupling member is disposed at the flange and configured to mate with the threaded coupling member of the nozzle head;

the nozzle base including a shoulder member at a base of the flange;

the nozzle base including a second threaded coupling member disposed at the proximal end, the second threaded coupling configured to mate with a water source;

an inner sleeve extending along the longitudinal axis and being generally cylindrical shaped, the inner sleeve having a main body sized for a bearing engagement between the closed top member of the nozzle head and the shoulder of the nozzle base, an annular chamber being formed between the inner sleeve and the nozzle head, the fluid passageway extending therethrough; and the inner sleeve including a plurality of orifices distributed axially and circumferentially about the main body, each of the plurality of orifices extending along a respective orifice axis, each orifice axis being at a positive acute pitch relative to the longitudinal axis so that during operation fluid exits the plurality of orifices from the fluid passageway into the annular chamber toward the distal end of the nozzle head, each orifice axis being at the positive acute radial angle with respect to corresponding radial lines extending in planes perpendicular to the longitudinal axis so that during operation fluid exits the plurality of orifices toward a rotational direction, thereby imparting a rotation to the inner sleeve.

18. The fog-cloud generating nozzle as recited in claim 17, wherein the nozzle head is statically connected to the nozzle base by the threadable connection therebetween.

19. A fog-cloud generating nozzle comprising:

a nozzle head extending along a longitudinal axis and being generally cylindrical shaped, the nozzle head having a central body portion including a proximal end and a distal end;

the nozzle head having a closed top member at the distal end and a threaded coupling member at the proximal end with a fluid passageway therein extending from the threaded coupling member to the closed top member, the fluid passageway having a fluid passageway cross-sectional area perpendicular to the longitudinal axis;

the nozzle head having an internal central fluid cavity extending along the longitudinal axis in the central portion thereof;

the nozzle head having a plurality of elongated ports distributed axially and circumferentially about the central body portion, the plurality of elongated ports configured to provide fluid communication between the internal central fluid cavity and a surface of the nozzle;

the plurality of elongated ports being disposed in rows, each row having an acute pitch angle relative to the longitudinal axis so that during operation fluid exits the plurality of elongated ports toward the distal end, each row including approximately eight elongated ports, the rows being disposed in a close-packing arrangement;

the acute pitch of each row of the plurality of elongated ports being greater than the acute pitch of the previous row, the acute pitch of each row progressing through acute pitches of approximately 20 degrees, 35 degrees, 50 degrees, 65 degrees, and 80 degrees;

a nozzle base extending along the longitudinal axis, the nozzle base having a body member including a distal end and a proximal end, the fluid passageway extending therethrough;

the nozzle base having a flange extending from the distal end, a first threaded coupling member is disposed at the flange and configured to mate with the threaded coupling member of the nozzle head;

the nozzle base including a shoulder member at a base of the flange;

the nozzle base including a second threaded coupling member disposed at the proximal end, the second threaded coupling configured to mate with a water source;

an inner sleeve extending along the longitudinal axis and being generally cylindrical shaped, the inner sleeve having a main body sized for a bearing engagement between the closed top member of the nozzle head and the shoulder of the nozzle base, an annular chamber being formed between the inner sleeve and the nozzle head, the fluid passageway extending therethrough; and the inner sleeve including a plurality of orifices distributed axially and circumferentially about the main body, each of the plurality of orifices extending along a respective orifice axis, each orifice axis being at a positive acute pitch of approximately 30 degrees relative to the longitudinal axis so that during operation fluid exits the plurality of orifices from the fluid passageway into the annular chamber toward the distal end of the nozzle head, each orifice axis being at the positive acute radial angle with respect to corresponding radial lines extending in planes perpendicular to the longitudinal axis so that during operation fluid exits the plurality of orifices toward a rotational direction, thereby imparting a rotation to the inner sleeve.

20. The fog-cloud generating nozzle as recited in claim 19, wherein the nozzle head is statically connected to the nozzle base by the threadable connection therebetween.

* * * * *